US005443136A

United States Patent [19]

Ott, III et al.

[11] Patent Number: 5,443,136

[45] Date of Patent: Aug. 22, 1995

[54] SAFETY STEPLADDER

[75] Inventors: Edward J. Ott, III, 2960 W. Carmino Carmelia, Tucson, Ariz. 85745; Robert A. Walcott, Jr., Tucson, Ariz.

[73] Assignee: Edward J. Ott, III, Tucson, Ariz.

[21] Appl. No.: 264,891

[22] Filed: Jun. 24, 1994

[51] Int. Cl.[6] ..... E06C 7/00

[52] U.S. Cl. ..... 182/172; 182/107; 182/80

[58] Field of Search ..... 182/172, 161, 180, 107, 182/33

[56] References Cited

U.S. PATENT DOCUMENTS

| | | | |
|---|---|---|---|
| 2,423,477 | 7/1947 | Brimboeuf | 182/172 X |
| 3,395,776 | 8/1968 | Russell . | |
| 4,485,892 | 12/1984 | Maloney | 182/161 |
| 4,964,488 | 10/1990 | Stewart . | |
| 5,086,876 | 2/1992 | Severson . | |
| 5,226,504 | 7/1993 | Bumbera . | |

FOREIGN PATENT DOCUMENTS

| | | | |
|---|---|---|---|
| 0039078 | 11/1981 | European Pat. Off. | 182/172 |
| 3941121 | 6/1990 | Germany | 182/172 |

*Primary Examiner*—Alvin C. Chin-Shue

*Attorney, Agent, or Firm*—Mallinckrodt & Mallinckrodt

[57] ABSTRACT

A stepladder, which may be in the form of a usual stepladder/stool combination, is provided with safety outboard frame members desirably of inverted U-shape providing upwardly arched hand holds extending upwardly beyond the upper step of the stepladder sufficiently to obstruct lateral movement beyond the ends of such upper step of the legs of a person standing on such upper step. The stepladder/stool combination in particular is preferably provided with a latching arrangement limiting movement of the safety frame members from safety positions during use of the stepladder and for not permitting the stepladder to be placed into condition for use until such safety frame members are in safety positions.

12 Claims, 3 Drawing Sheets

SAFETY STEPLADDER

BACKGROUND OF THE INVENTION

1. Field

The invention is in the field of foldable stepladders having safety provisions providing lateral stability.

2. State of the Art

Various provisions to provide structural stability for foldable stepladders have been proposed in the way of structures fastened to the sides of a stepladder and extendable laterally therefrom, as in U.S. Pat. Nos. 5,226,504; 5,086,876; 4,964,488, and 3,395,776. However, these don't provide requisite stability for the user even though they do for the ladder itself.

SUMMARY OF THE INVENTION

In the making of the present invention, a primary objective was to provide stability for the user of a stepladder as well as for the ladder itself.

This was accomplished in accordance with the invention by extending, upwardly, the safety supporting structure that, as heretofore proposed, is fastened to the sides of the stepladder and is foldable laterally therefrom. As so extended to above the top step of the stepladder to provide handholds for the user, or at least far enough above such top step to provide obstructions laterally for the legs of the user against lateral movement beyond the limits of the supporting step, and preferably also formed with hand-holds, user stability is achieved.

The upwardly extended supporting structure is desirably in the form of a pair of inverted, U-shaped, outboard frame members pivotally mounted to the stiles of the stepladder, respectively, adjacent to the top step of the stepladder, so as to be swingable outwardly to provide the requisite safety support laterally of such stepladder, with the outer leg of each such outboard frame member having the requisite length to reach the floor or other supporting surface on which the stepladder rests and with the crossbar of the U being curved in arch formation and rising above such top step as a hand-hold for the user.

An additional objective was to provide a combination stepladder and stool having the above safety provisions and being easily foldable and unfoldable, preferably with special provision for not permitting it to be placed into condition for use until the safety frame members are latched into their safety positions.

This was accomplished by integrating the afore-mentioned, inverted, U-shaped, outboard frame members into the usual stepladder-stool construction, with the inner leg of each U-shaped safety frame interposed between the front and back supporting portions of the usual combined stepladder and stool immediately above the top step, i.e. stool seat, thereof, with its lower end telescopically received by a stub receiving member pivotally fastened to the corresponding end of such top step or stool seat so that each entire U-shaped, supporting, safety frame member can be swung inwardly against the stepladder-stool when not in use and outwardly through respective angles of about ninety degrees (90°) into safety position for use.

THE DRAWINGS

Shown by the enclosed drawings is an embodiment of the invention presently contemplated as the best mode of carrying the invention out in actual practice, wherein:

FIG. 1 is a pictorial view looking from one side and the front of a stool and stepladder combination unfolded for use;

FIG. 2, a rear elevation of the unfolded stool and stepladder combination of FIG. 1 looking from the line 2—2 of FIG. 1;

FIG. 3, a side elevation of the unfolded stool and stepladder combination of the foregoing figures looking from the line 3—3 in FIG. 2;

FIG. 4, the fragmentary portion of FIG. 3 encircled by the line 4—4 of FIG. 3 and drawn to a larger scale;

FIG. 5, a rear elevation of the fragmentary portion shown in FIG. 4 taken from the standpoint of the line 5—5 of FIG. 4;

FIG. 6, a top plan view of the fragmentary portion of FIG. 5 taken from the standpoint of the line 6—6 of FIG. 4;

FIG. 7, a fragmentary vertical section taken on the line 7—7 of FIG. 3 and drawn to the larger scale of FIGS. 4—6;

FIG. 8, a side elevation of the stool and stepladder combination of FIG. 1 as folded for moving from place to place and storage;

FIG. 9, the fragmentary portion of FIG. 8 encircled by the line 9—9 of FIG. 8 and drawn to the larger scale of FIGS. 4–7;

FIG. 10, a side elevation of the fragmentary portion of FIG. 9 taken from the standpoint of the line 10—10 of FIG. 9; and FIG. 11, a top plan view of the fragmentary portion of FIG. 9 taken from the standpoint of the line 11—11 of FIG. 9.

DETAILED DESCRIPTION OF THE ILLUSTRATED EMBODIMENT

Figure 1:
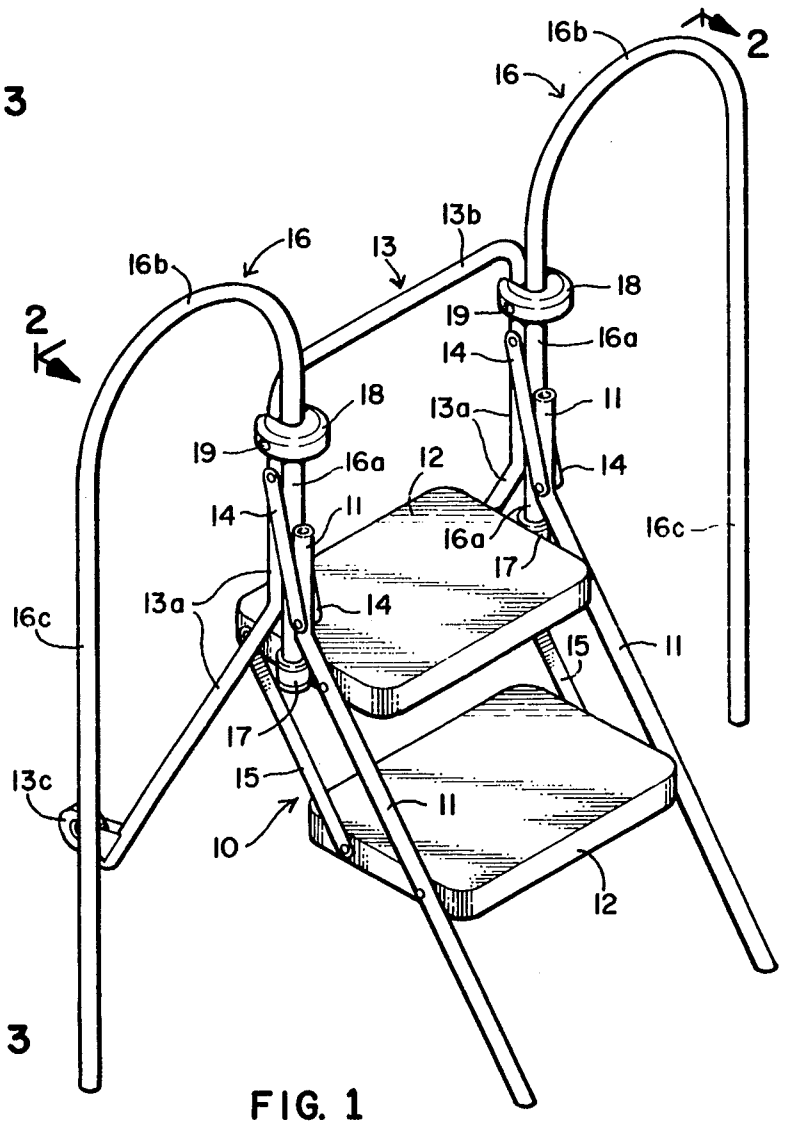

In the form illustrated, a combination stepladder and stool 10 is, in general, of conventional construction having stiles 11, respectively, between which and pivotally secured at opposite ends thereto are lower and upper steps 12, respectively. A supporting back portion 13 having legs **13*a* connected together by an upper crossmember 13*b* is pivotally secured at opposite lateral sides thereof to the stiles 11 by means of a pair of double braces 14, respectively, the steps 12 themselves being pivotally secured together by a pair of single braces 15, respectively, so the ladder and stool combination is foldable for movement on wheels 13*c* or for storage. As is usual, the top step 12** serves as the stool seat.

In accordance with the invention, a pair of outboard safety frame members 16, respectively, of inverted U-shape have their inside legs **16*a* pivotally mounted to opposite ends, respectively, of upper step 12 so such safety frame members can be swung toward and away from the front of stool ladder 10. A crossmember 16*b* at the upper end of each of the inverted U-shaped safety frame members 16, connecting the inside leg 16*a* thereof with the outside leg 16*c*, rises above the top step 12 of the stool ladder combination 10, as also does the upper end 13*b* of the supporting back portion 13 thereof, by a distance sufficient to provide obstruction to movement laterally, as well as back of such top step 12** by a person standing on such top step.

The crossmembers **16*b* of the safety frame members 16** are desirably upwardly arched to provide convenient hand-holds for a person using the stepladder.

Figure 7:
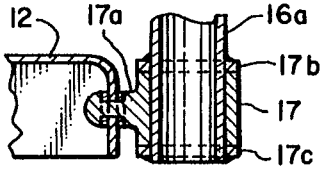

For telescopically receiving the lower end of the inside leg 16*a* of the corresponding safety member 16, each lateral end of the top step 12 of the stepladder stool 10 has pivotally secured thereto a receiving stub member 17. As shown in FIG. 7, such stub member 17 is pivotally attached to top step 12 by a stem 17*a*. This enables safety members 16 to more or less accommodate various conditions of use. As also shown in FIG. 7, there are provided means, conveniently in the form of an upper ring 17*b* and a lower ring 17*c* fastened as by welding to the lower end of leg 16*a*, to prevent vertical movement of said leg 16*a* in stub member 17 after installation therein.

Figure 2:
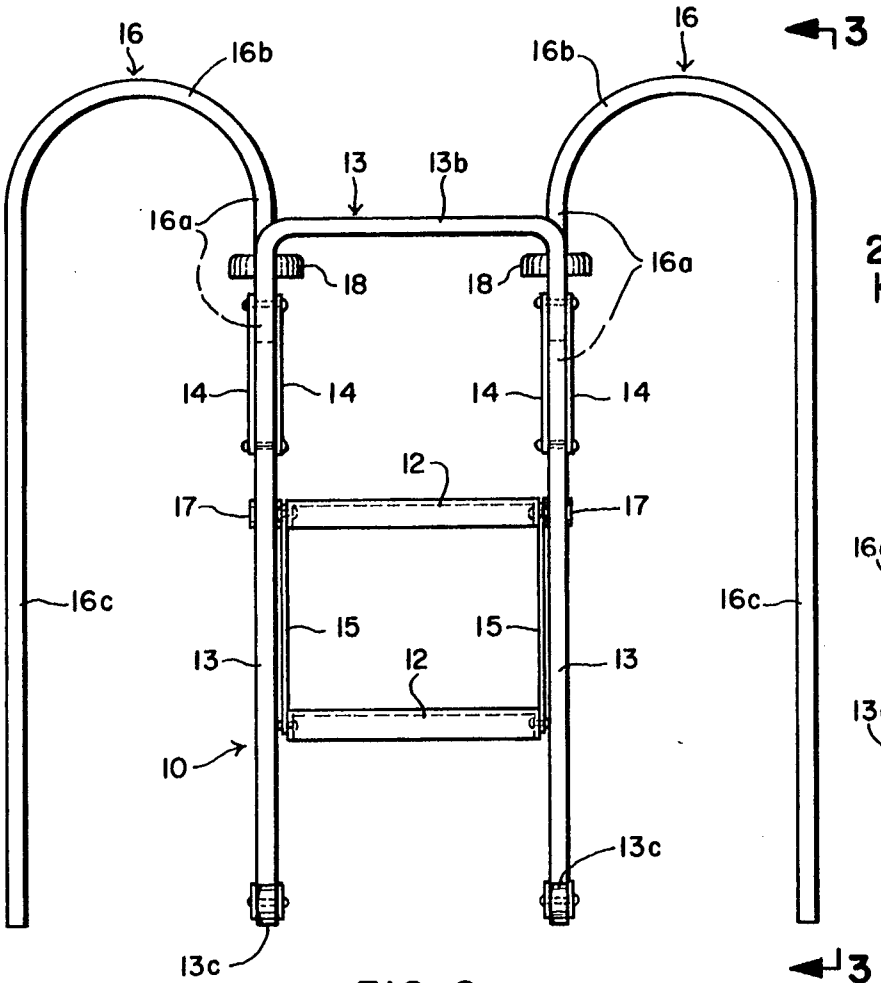
Figure 3:
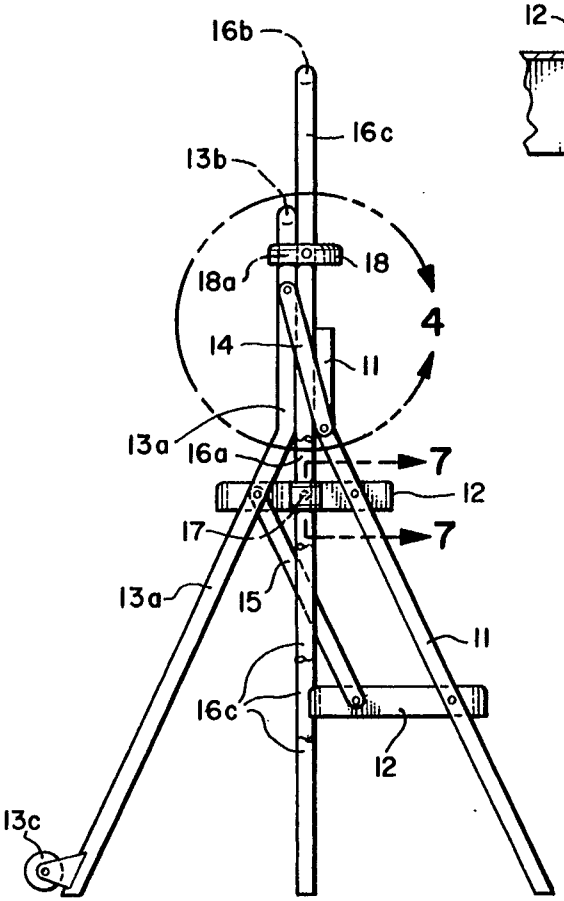
Figure 11:
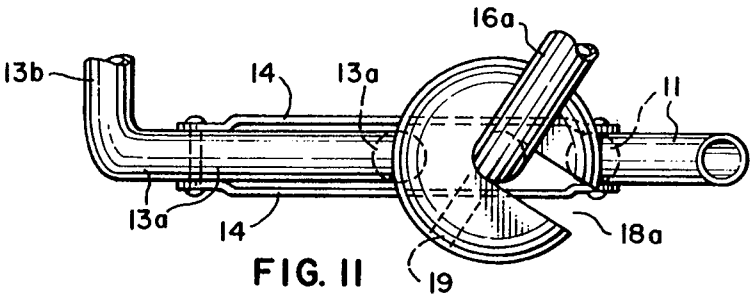
Figure 9:
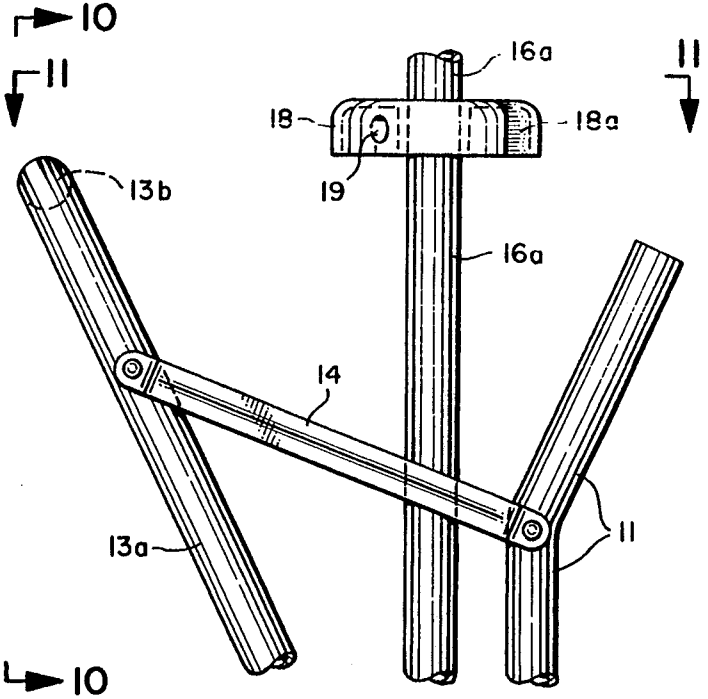
Figure 10:
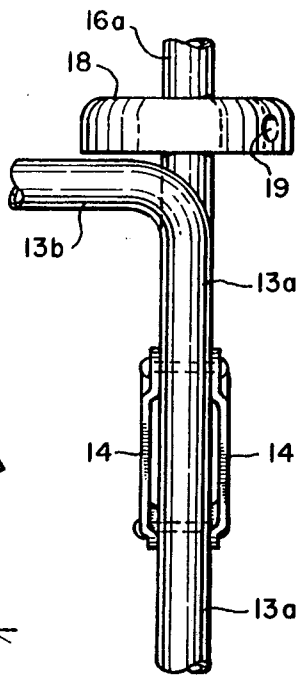
Figure 8:
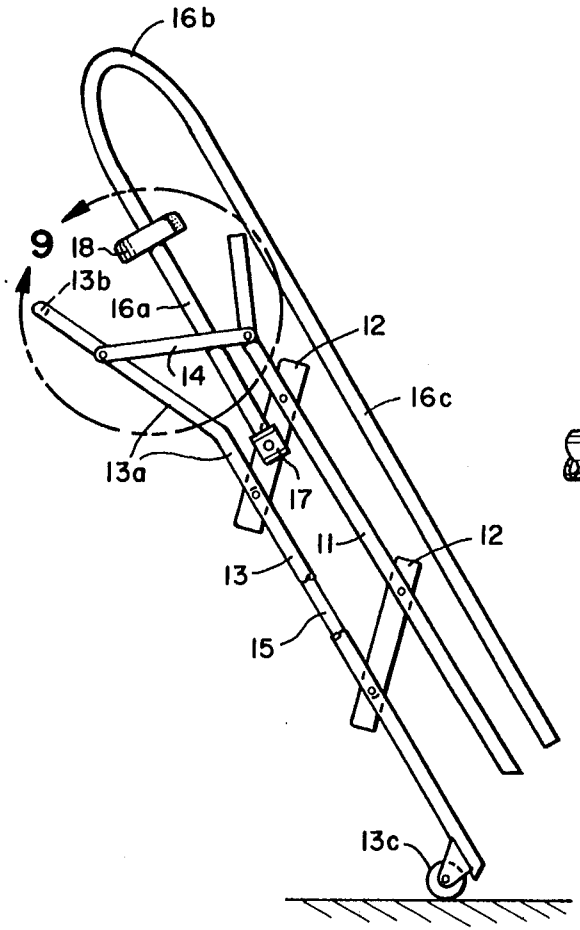

For use of the stepladder stool combination 10, such safety frame members 16 are swung from the overlapped folded positions thereof in front of the steps 12, see the position of the one safety member 16, shown in FIG. 8, to the laterally extended, unfolded position thereof shown in FIGS. 1, 2, and 3.

Figure 6:
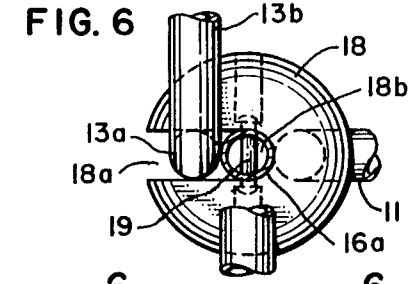
Figure 4:
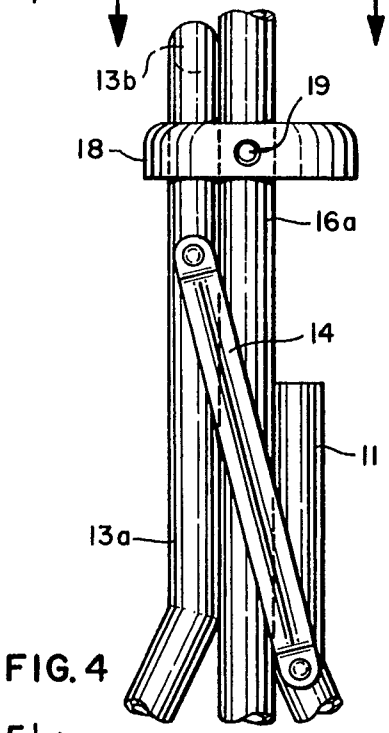
Figure 5:
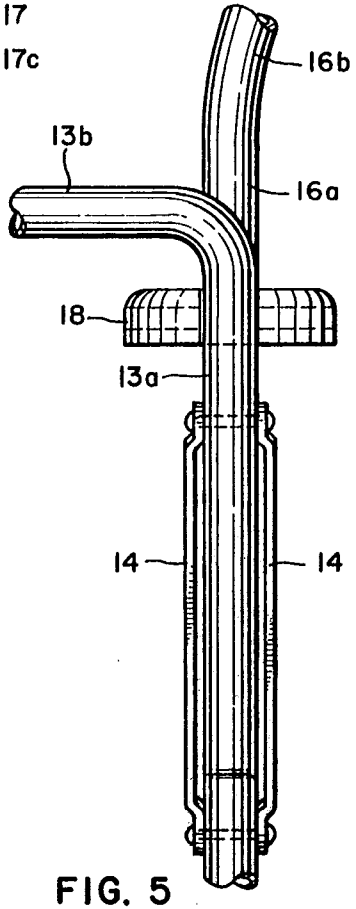

For latching such safety frame members 16 in their extended safety positions during use and for not permitting the stepladder stool combination 10 to be placed into condition for use until the safety members 16 are latched into their safety positions, it is advantageous that latch discs 18 be provided and be fastened rigidly to upper portions of the inside legs 16*a* of such safety frame members, as by respective pins 19, see particularly FIG. 6.

Latch discs 18 are each provided with a radial latch slot 18*a*, FIGS. 6 and 8 extending from a central opening 18*b* and enabling installation of the disc on a safety frame member 16 with the inside leg 16*a* of such safety frame member being received by and passing through the opening 18*b* leaving the latch slot 18*a* free to permit latching entry thereinto of a corresponding leg 13*a* of the back portion 13 of the ladder stool 10, just below the crossmember 13*b* of such back portion, when the ladder stool 10 is set up for use as in FIGS. 1–3. As so latched, back portion 13 is prevented from moving laterally during use of the ladder, safety frame members 16 having been swung from the folded positions thereof of FIGS. 8–11 to the ladder use positions thereof of FIGS. 1–3.

Following use of the ladder stool 10 with the safety frame members 16 extended laterally into safety positions, the back portion 13 thereof is first pushed backwardly to disengage its legs 13*a* from their corresponding slots 18*a* in latching discs 18, compare FIG. 1 with FIG. 6, so the safety frame members 16 disengage, and become free of, back member 13 and can be swung into the folded positions indicated in FIG. 8, the folded ladder stool 10 can be wheeled to a new position for use or to a closet or other area for storage.

It will be noted that stepladders of the present invention provide for the center of gravity of a user to remain within the safety limits of the stepladder even when the user leans laterally quite far beyond the stiles of the stepladder.

Whereas this invention is here illustrated and described with reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

We claim:

1. In a safety stepladder having a ladder portion providing a series of steps, each fastened at its opposite ends to a pair of stiles, respectively; a ladder-supporting back portion pivotally mounted at its upper end to the upper end of said ladder portion so as to swing toward and away from said ladder portion in the setting up and taking down of the stepladder; and outboard safety frame members pivotally mounted adjacent to their upper ends to the stiles, respectively, of said ladder portion, with lower ends thereof adapted to rest on a ladder-supporting surface spaced laterally from said ladder portion when said safety frame members are swung outwardly of said ladder portion into safety positions, the improvement wherein the pivotal mounting and the length of each of said safety frame members are such that the upper ends of said safety frame members extend above the top step of said ladder portion sufficiently, and are formed, to provide hand-holds; and wherein the outboard safety frame members are of inverted U-shape, respectively, having inside and outer leg members and an upwardly arched crossbar extending above the top step of the ladder portion as said hand-holds when said safety frame members are swung into safety positions.

2. An improvement in safety stepladders in accordance with claim 1, wherein the stepladder is a combination ladder and stool with the top step providing the stool.

3. An improvement in safety stepladders in accordance with claim 2, wherein latching means are provided for maintaining the outboard safety frame members in safety positions during use.

4. An improvement in safety stepladders in accordance with claim 1, wherein latching means are provided for maintaining the outboard safety frame members in safety positions during use; and wherein the latching means comprises latching members fastened rigidly to the outboard safety frame members, respectively, at their pivotal mountings to the stiles for engaging respective portions of the ladder-supporting back portions in the set-up condition of the ladder/stool combination.

5. An improvement in a safety stepladder in accordance with claim 1, wherein the inside leg member of each of the inverted, U-shaped, outboard safety frame members is telescoped pivotally into a stub receiving member secured to the corresponding end of the top step of the ladder portion, with the outer leg member extending downwardly to the level of the lower end of said ladder portion; and means attaching said received end of the outboard frame member to said stub member so as to be able to pivot therein.

6. An improvement in a safety stepladder in accordance with claim 4, wherein the latching means comprises discs fastened concentrically to the inside legs, respectively, of the respective outboard safety frame members, each of the said discs being provided with a radial latching slot adapted to receive a leg of the back portion of the ladder stool combination.

7. An improvement in a safety stepladder in accordance with claim 6, wherein the stepladder stool combination is pivotally arranged to fold together when the legs of the back portion of the ladder are disengaged from their latching slots.

8. In a safety stepladder having a ladder portion providing a series of steps, each fastened at its opposite ends to a pair of stiles, respectively; a ladder-supporting back portion pivotally mounted at its upper end to the upper end of said ladder portion so as to swing toward and away from said ladder portion in the setting up and taking down of the stepladder; and outboard safety frame members pivotally mounted adjacent to their upper ends to the stiles, respectively, of said ladder portion, with lower ends thereof adapted to rest on a ladder-supporting surface spaced laterally from said ladder portion when said safety frame members are swung outwardly of said ladder portion into safety positions, the improvement wherein the pivotal mounting and the length of each of said safety frame members are such that the upper ends of said safety frame members extend above the top step of said ladder portion sufficiently, and are formed, to provide a lateral obstruction at the corresponding end of said top step to lateral movement of the corresponding leg of a user of the stepladder beyond the corresponding end of said top step and to provide hand-holds; and wherein the outboard safety frame members are of inverted U-shape, respectively, having inside and outer leg members and an upwardly arched crossbar extending above the top step of the ladder portion as said hand-holds when said safety frame members are swung into safety positions.

9. An improvement in safety stepladders according to claim 8, wherein the inside leg member of each of the inverted, U-shaped, outboard safety frame members is telescoped pivotally into a stub receiving member secured to the corresponding end of the top step of the ladder portion, with the outer leg member extending downwardly to the level of the lower end of said ladder portion; and means attaching said received end of the outboard frame member to said stub member so as to be able to pivot therein.

10. In a safety stepladder having a ladder portion providing a series of steps, each fastened at its opposite ends to a pair of stiles, respectively; a ladder-supporting back portion pivotally mounted at its upper end to the upper end of said ladder portion so as to swing toward and away from said ladder portion in the setting up and taking down of the stepladder; and outboard safety frame members pivotally mounted adjacent to their upper ends to the stiles, respectively, of said ladder portion, with lower ends thereof adapted to rest on a ladder-supporting surface spaced laterally from said ladder portion when said safety frame members are swung outwardly of said ladder portion into safety positions, the improvement wherein the pivotal mounting and the length of each of said safety frame members are such that the upper ends of said safety frame members extend above the top step of said ladder portion sufficiently, and are formed, to provide a lateral obstruction at the corresponding end of said top step to lateral movement of the corresponding leg of a user of the stepladder beyond the corresponding end of said top step and to provide hand-holds; wherein the outboard safety frame members are of inverted U-shape, respectively, having inside and outer leg members and an upwardly arched crossbar extending above the top step of the ladder portion as said hand-holds when said safety frame members are swung into safety positions; wherein the stepladder is a combination ladder and stool with the top step providing the stool; wherein latching means are provided for maintaining the outboard safety frame members in safety positions during use; and wherein the latching means comprises latching members fastened rigidly to the outboard safety frame members, respectively, at their pivotal mountings to the stiles for engaging respective portions of the ladder-supporting back portions in the set-up condition of the ladder/stool combination.

11. An improvement in safety stepladders in accordance with claim 10, wherein the latching means comprises discs fastened concentrically to the inside legs, respectively, of the respective outboard safety frame members, each of the said discs being provided with a radial latching slot adapted to receive a leg of the back portion of the ladder stool combination.

12. An improvement in safety stepladders in accordance with claim 11, wherein the stepladder stool combination is pivotally arranged to fold together when the legs of the back portion of the ladder are disengaged from their latching slots.

* * * * *